United States Patent [19]

Irvin

[11] 3,970,167

[45] July 20, 1976

[54] ROTARY FLOW MUFFLER

[76] Inventor: Joseph C. Irvin, 756 Ivy Road, Memphis, Tenn. 38117

[22] Filed: May 12, 1975

[21] Appl. No.: 576,635

[52] U.S. Cl. ..... 181/58; 181/66

[51] Int. Cl.[2] ..... F01N 1/08; F01N 1/12

[58] Field of Search ..... 181/58, 66, 67, 35 A, 181/35 R

[56] References Cited

UNITED STATES PATENTS

| | | | |
|---|---|---|---|
| 2,468,384 | 4/1949 | Tyskewicz | 181/66 |
| 3,374,857 | 3/1968 | Hutchins | 181/58 |
| 3,530,953 | 9/1970 | Conlin | 181/58 |

FOREIGN PATENTS OR APPLICATIONS

| | | | |
|---|---|---|---|
| 300,909 | 5/1968 | Sweden | 181/58 |

*Primary Examiner*—Stephen J. Tomsky
*Attorney, Agent, or Firm*—John R. Walker

[57] ABSTRACT

A device for silencing the exhaust of an internal combustion engine. The interior of a hollow body member is divided into first, second and third chambers by first and second baffle members. An inlet port allows the exhaust from the engine to enter the first chamber. The body member is adapted to cause the exhaust entering the first chamber through the inlet port to rotate in a first direction. A plurality of ports in the first baffle member allows the exhaust to pass from the first chamber into the second chamber. The plurality of ports in the first baffle member are adapted to cause the exhaust entering the second chamber through the plurality of ports to rotate in a second direction substantially opposite the direction of rotation of the exhaust in the first chamber. A plurality of ports are provided in the second baffle member to allow the exhaust to pass from the second chamber into the third chamber. The plurality of ports in the second baffle member are adapted to cause the exhaust entering the third chamber through the plurality of ports to rotate in a third direction substantially opposite the direction of rotation of the exhaust in the second chamber. An outlet port allows the exhaust from the engine to exit the third chamber.

11 Claims, 6 Drawing Figures

ROTARY FLOW MUFFLER

BACKGROUND OF THE INVENTION

1. Field of the Invention:

This invention relates to means for silencing the exhaust of internal combustion engines.

2. Description of the Prior Art:

Heretofore, various means have been developed to silence the exhaust of internal combustion engines. See, for example, Redeker et al (U.S. Pat. No. 1,304,096), Webb (U.S. Pat. No. 1,840,862), Van Dyke (U.S. Pat. No. 1,842,921), Wright (U.S. Pat. No. 2,511,190), Reindl (U.S. Pat. No. 2,788,078) and Betts (U.S. Pat. No. 3,077,240). None of the above patents disclose or suggest the present invention.

The known prior means for silencing the exhaust of internal combustion engines are disadvantageous in that their useful life is limited. This limited useful life is caused by the deterioration of the internal structure of the silencing means by the hot exhaust from the engine. This deterioration is largely due to the fact that these prior silencing means include many internal fastening and fittings and the fact that the baffle members in these prior silencing means are arranged substantially perpendicular to the flow of the exhaust through the silencing means.

SUMMARY OF THE INVENTION

The present invention is directed towards overcoming the problems and disadvantages of prior means for silencing the exhaust of internal combustion engines. The concept of the present invention is to provide a rotary flow muffler which effectively silences the exhaust of internally combustioned engines and which has a substantially unlimited useful life.

The rotary flow muffler of the present invention includes a hollow body member having first and second baffle members fixedly positioned in the interior thereof to divide the interior into first, second and third chambers. The body member includes an inlet port for allowing the exhaust from an internal combustion engine to enter the first chamber. An important feature of the present invention is the fact that all the parts thereof are joined together externally of the interior of the body members so as not to subject the fittings to hot exhaust from the engine. The body member is adapted to cause the exhaust entering the interior thereof through the inlet port to rotate in a first direction. Preferably, the inlet port is adapted to cause the exhaust from the engine to enter the first chamber in a direction substantially parallel to the first baffle member. The first baffle member included a plurality of ports for allowing the exhaust from the engine to pass from the first chamber of the body member to the second chamber therof. The plurality of ports of the first baffle member are adapted to cause the exhaust entering the second chamber therethrough to rotate in a second direction substantially opposite the direction of rotation of the exhaust in the first chamber. The second baffle member includes a plurality of ports for allowing the exhaust from the engine to pass from the second chamber of the body member to the third chamber thereof. The plurality of ports of the second baffle member are adapted to cause the exhaust entering the third chamber thereto to rotate in a third direction substantially opposite the direction of rotation of the exhaust in the second chamber. The body member includes an outlet port for allowing the exhaust from the engine to exit the third chamber.

DESCRIPTION OF THE PREFERRED EMBODIMENT

Figure 1:
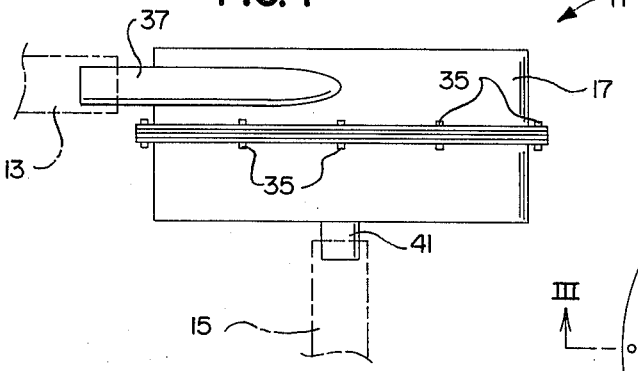
FIG. 1 is an elevational view of the rotary flow muffler of the present invention showing the exhaust pipe of an internal combustion engine in phantom lines.
Figure 2:
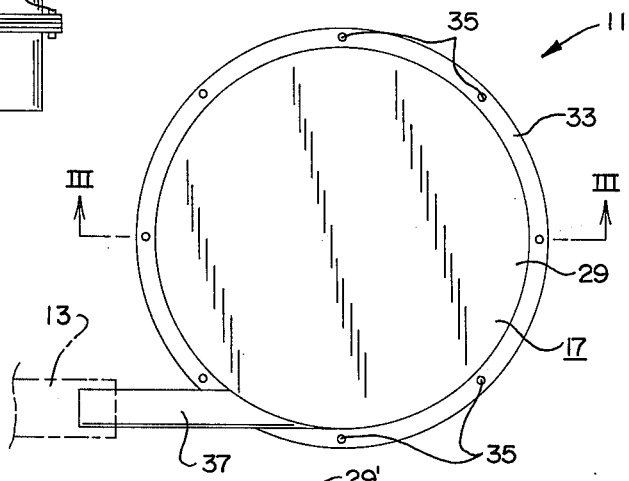
FIG. 2 is a top plan view of FIG. 1.

The rotary flow muffler 11 of the present invention is for positioning intermediate the exhaust pipe of an internal combustion engine to silence the exhaust of the engine. More specifically, the rotary flow muffler 11 is adapted to be attached to an exhaust pipe 13 which carries the exhaust of the internal combustion from the engine (not shown) to the rotary flow muffler 11 and is adapted to be attached to an exhaust pipe 15 which carries the exhaust of the engine from the rotary flow muffler 11 to the atmosphere. The rotary flow muffler 11 includes, in general, a hollow circular body member 17, a first baffle member 19 and a second circular baffle member 21. The first and second baffle members 19, 21, are fixedly positioned in the interior of the body member 17 to divide the interior of the body 17 into a first chamber 23, a second chamber 25 and a third chamber 27.

Figure 4:
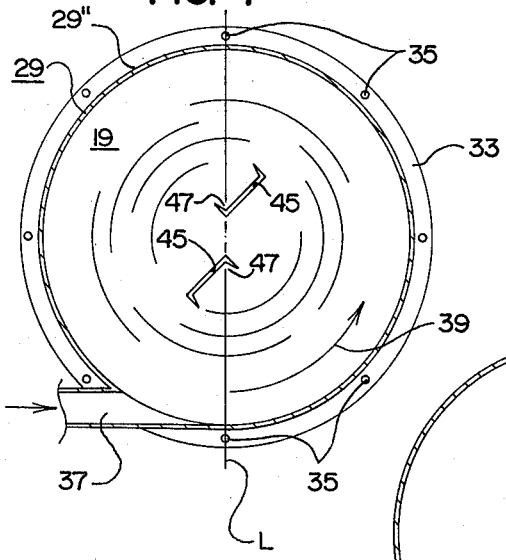
FIG. 4 is a sectional view of the present invention as taken on line IV—IV of FIG. 3.

The body member 17 preferably includes a first pan-like member 29 and a second pan-like member 31. The first pan-like member 29 is preferably composed of a circular plate portion 29' and a cylindrical wall portion 29''. Likewise, the second pan-like member 31 is preferably composed of a circular plate portion 31' and a cylindrical wall portion 31''. Each of the first and second pan-like members 29, 31 is preferably provided with a rim portion 33 for allowing the first and second pan-like members 29, 31 to be joined together by externally located rivets 35, welding or the like. The first pan-like member 29 of the body member 17 includes an inlett port 37 for attachment to the exhaust pipe 13 to allow the exhaust from the engine to enter the first chamber 23 of the body member 17. The body member 17 is adapted to cause the exhaust entering the body member 17 through the inlet port 37 to rotate in a first direction. That is, the inlet port 37 is preferably located at a tangent to the interior surface of the cylindrical wall portion 29'' of the first pan-like member 29 and substantially parallel with the plane of the first baffle member 19 as shown by FIG. 4 to cause the exhaust entering the body member 17 through the inlet port 37 to rotate in a first direction or counterclockwise as indicated by the arrow 39. The second pan-like member 31 indicates an outlet port 41 for attachment to the exhaust pipe 15 of the engine to allow the exhaust from the engine to exit the third chamber 27. The outlet port 41 is preferably located in the center of the second pan-like member 31.

Figure 3:
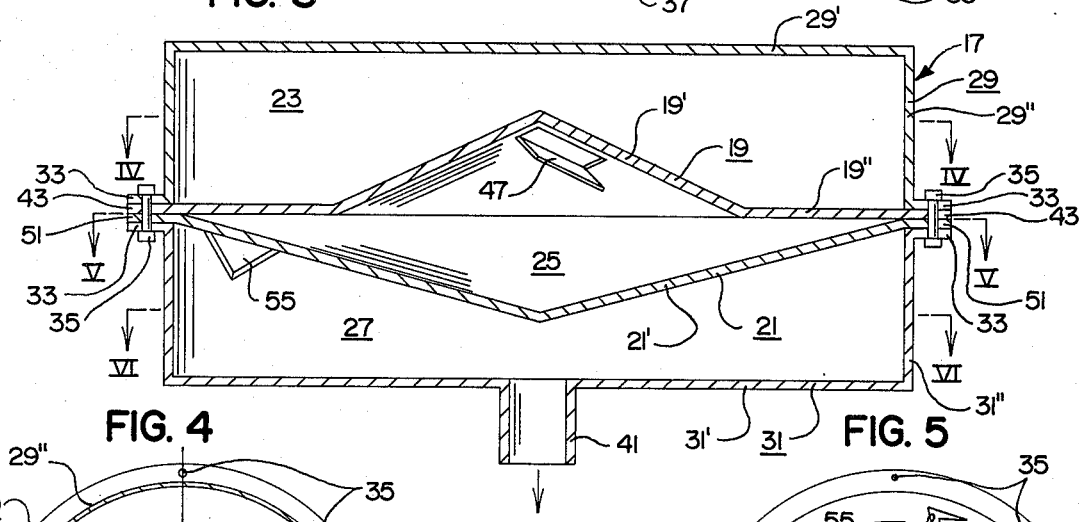
FIG. 3 is a sectional view of the present invention as taken on line III—III of FIG. 2.
Figure 5:
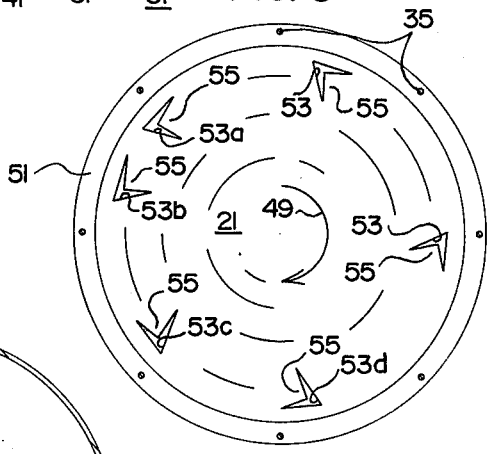
FIG. 5 is a sectional view of the present invention as taken on line V—V of FIG. 3.

The first baffle member 19 preferably includes a rim portion 43 substantially corresponding to the rim portions 33 of the first and second pan-like member 29, 31, for allowing the first baffle member 19 to be fixedly positioned in the interior of the body member 17 intermediate the first and second pan-like members 29, 31, by means such as the externally located rivets 35 or the like. The first baffle member 19 includes a plurality of centrally disposed ports for allowing the exhaust from the engine to pass from the first chamber 23 of the body member 17 to the second chamber 25 thereof. More specifically, in the preferred embodiment the first baffle member 19 includes a pair of centrally disposed ports 45 for allowing the exhaust from the engine to pass from the first chamber 23 to the second chamber 25. The pair of ports 45 are adapted to cause the exhaust entering the second chamber 25 through the pair of ports 45 to rotate in a second direction substantially opposite the direction of rotation of the exhaust in the first chamber 23 or to assume an outward spiraling movement. More specifically, the first baffle means 19 preferably includes a tonguelike portion 47 juxtaposed attached to each of the pair of centrally disposed ports 45 for causing the exhaust entering the second chamber 25 through the pair of ports 45 to rotate in the clockwise or second direction as indicated by the arrow 49 (see FIG. 5) substantially opposite the direction of rotation of the exhaust in the first chamber 23. The pair of ports 45 are preferably rectangularly shaped and positioned with the long side of the rectangle substantially at a 45° angle to a radius line L which extends therethrough (see FIG. 4). The tonguelike portions 47 are preferably attached to the long side of each rectangularly shaped port 45 that is leeward of the flow of exhaust gases in the first chamber 23 (see FIG. 4). The first baffle member 19 preferably includes a substantially conically shaped portion 19' with the apex of the cone directed away from the second baffle member 21 and includes a flat, plate-like member 19'' joining the conically shaped portion 19' and the rim portion 43 (see FIG. 3). The pair of ports 45 are preferably located substantially adjacent the apex of the cone of the first baffle member. The combined open space provided by the pair of ports 45 is preferably at least equal in area to the open space provided by the inlet port 37 of the body member 17 so as not to restrict the passage of the exhaust from the engine.

Figure 6:
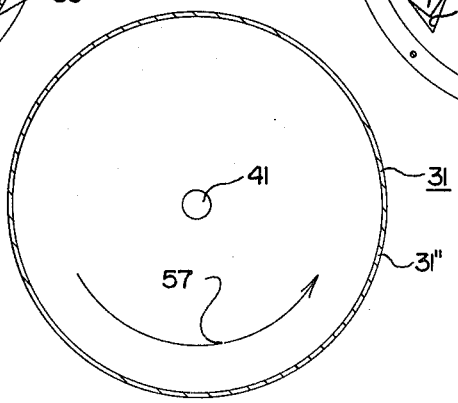
FIG. 6 is a sectional view of the present invention as taken on line VI—VI of FIG. 3.

The second baffle member 21 is preferably provided with a rim portion 51 for allowing the second baffle member 21 to be attached intermediate the rim portions 33 of the first and second pan-like members 29, 31 by the externally located rivets 35 or the like. The second baffle member 21 is provided with a plurality of peripherally disposed ports for allowing the exhaust from the engine to pass from the second chamber 25 of the body member 17 to the third chamber 27 thereof. In the preferred embodiment, the plurality of ports in the second baffle member 21 consists of six ports 53. The combined open space provided by the plurality of ports in the second baffle member 21 is preferably at least equal in the area to the open space provided by the inlet port 37 of the body member 17 so as not to restrict the flow of exhaust from the engine therethrough. Each of the plurality of ports of the second baffle member 21 is adapted to cause the exhaust entering the third chamber 27 thereto to rotate in a third direction substantially opposite the direction of rotation of the exhaust in the second chamber 25. More specifically, the second baffle member 21 preferably includes a tonguelike portion or peripheral vertical vane 55 juxtaposed attached to each of the plurality of peripheral ports for causing the exhaust entering the third chamber 27 through the plurality of ports in the second baffle member 21 to rotate counterclockwise in the direction indicated by the arrow 57 (see FIG. 6) substantially opposite the direction of rotation of the exhaust in the second chamber 25. The second baffle member 21 preferably includes a substantially conically shaped portion 21' with the apex of the cone being directed away from the first baffle member 19 (see FIG. 3). The six ports 53 of the second baffle member 21 are preferably located substantially adjacent to the base of the cone. The six ports 53 are preferably substantially triangularly shaped and positioned with one side of the triangle substantially at a right angle to the direction of rotation of the exhaust in the second chamber 25. The tonguelike portions or peripheral vertical vanes 55 are preferably adapted to cause the exhaust entering the third chamber 27 through the plurality of ports in the secnd baffle member 21 to be directed outwardly. More specifically, the tonguelike portions 55 are preferably attached to one side of the triangle of each of the substantially triangularly shaped ports 53 that is not located at substantially a right angle to the direction of rotation of the exhaust in the second chamber 25 i.e., the side of each triangular shaped port 53 that is leeward of the flow of exhaust gas in the second chamber 25 (see FIG. 5) and that is angled outwardly from the side that is located substantially at a right angle to the direction of rotation of the exhaust in the second chamber 25. The six ports 53 are preferably progressively spaced apart relative to one another to prevent any resonant effect that may occur as the exhaust passes from the second chamber 25 to the third chamber 27. For example, the ports **53*a* and 53*b* may be spaced apart a distance of 1 inch (2.54 cm.), the ports 53*b* and 53*c* a distance of 2 inches (5.08 cm.), and the portts 53*c* and 53*d* a distance of 3 inches (7.62 cm.), etc. The exact spacing of the ports 53 will, of course, depend on the size of the rotary flow muffler 11.**

Although the present invention has been described and illustrated with respect to a preferred embodiment thereof, it is not to be so limited since changes and modifications may be made therein which are within the full intended scope of the invention.

I claim:

1. A rotary flow muffler for reducing the noise caused by exhaust gases emanating from an internal combustion engine, said muffler comprising a hollow circular body; first and second circular baffle memberrs fixedly interposed within said circular body, portions of said first and second baffle members being spaced apart from one another to divide the interior of said body into first, second, and third chambers; an inlet port commmunicating said first chamber with the exhaust structure of the engine with said inlet port being disposed substantially tangentially with respect to said circular body and being substantially parallel with the plane of said first baffle member for controllably directing the flow of exhaust gases to provide a spiraling counterclockwise motion within said first chamber, said first baffle member being provided with a plurality of centrally disposed ports for communicating said first and second chambers one with the other, said first baffle member including a plurality of central vortical vane means respectively being juxtapositioned relative to said plurality of centrally disposed ports for controllably redirecting the flow of the exhaust gases as they pass from said first chamber into said second chamber to provide an outward spiraling clockwise motion of the exhaust gases within said second chamber, said second baffle member being provided with a plurality of peripherally disposed ports for communicating said second and third chambers one with the other, said second baffle member including a plurality of peripheral vortical vane means respectively being juxtapositioned relative to said plurality of peripherally disposed ports for controllably redirecting the flow of the exhaust gases as they pass from said second chamber into said third chamber to provide a spiraling counterclockwise motion within said third chamber, and an outlet port concentrically disposed on said body for communicating said third chamber from without whereby the exhaust gases ultimately exit from said muffler.

2. The rotary flow muffler of claim 1 in which said first baffle member includes a substantially conically shaped portion with the apex of the cone being directed away from said second baffle member.

3. The rotary flow muffler of claim 1 in which said second baffle member includes a substantially conically shaped portion with the apex of the cone being directed away from said first baffle member.

4. The rotary flow muffler of claim 1 in which the combined open space provided by said centrally disposed ports of said first baffle member is at least equal in area to the open space provided by said outlet port of said body.

5. The rotary flow muffler of claim 4 in which each of said centrally disposed ports of said first baffle member is substantially rectangularly shaped and positioned with the long side of the rectangle being disposed substantially at a 45° angle relative to a radius line extending therethrough.

6. The rotary flow muffler of claim 3 in which said plurality of ports in said second baffle member consist of six progressively spaced apart ports located substantially adjacent the base of the cone of said second baffle member.

7. The rotary flow muffler of claim 6 in which the combined open space provided by said six ports of said second baffle member is at least equal in area to the open space provided by said inlet port of said body.

8. The rotary flow muffler of claim 7 in which each of said six ports of said second baffle member is substantially triangularly shaped and positioned with one side of the triangle being substantially at a right angle to the direction of rotation of the exhaust in said second chamber.

9. The rotary flow muffler of claim 2 in which said first baffle member includes an annular planar portion disposed circumjacent to said conical shaped portion.

10. The rotary flow muffler of claim 5 in which each of said central vortical vane means consists of a severed portion of said first baffle member, said severed portion of said first baffle member having a shape substantially identical to that of said central port, said severed portion of said first baffle member being attached to said first baffle member along the long side of said rectangular shaped portion that is leeward of the flow of exhaust gases in said first chamber and being bent toward said second baffle member to an angle of 35° to 40° with respect to the area of said first baffle member immediately adjacent to said port.

11. The rotary flow muffler of claim 8 in which each of said peripheral vortical vane means consists of a severed portion of said second baffle member, said severed portion of said second baffle member having a shape substantially identical to that of said peripheral port, said severed portion of said second baffle member being attached to said second baffle member along the side of said triangularly shaped port that is leeward of the flow of exhaust gases in said second chamber and being bent away from said first baffle member at an angle of substantially 35° to 40° with respect to the area of said second baffle member immediately adjacent to said port.

* * * * *